US011933024B2

(12) United States Patent
Andreuccetti et al.

(10) Patent No.: US 11,933,024 B2
(45) Date of Patent: Mar. 19, 2024

(54) SYSTEM AND METHOD FOR CONTROLLING PUMP OPERATING SPEED RANGE OF AN ELECTRIC WORK VEHICLE BASED ON HYDRAULIC FLUID PRESSURE

(71) Applicant: CNH Industrial America LLC, New Holland, PA (US)

(72) Inventors: Christopher Alan Andreuccetti, Burlington, IA (US); Joseph R. Shoemaker, West Burlington, IA (US); Nicholas Chibucos, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 17/802,732

(22) PCT Filed: Feb. 25, 2021

(86) PCT No.: PCT/US2021/019506
§ 371 (c)(1),
(2) Date: Aug. 26, 2022

(87) PCT Pub. No.: WO2021/173742
PCT Pub. Date: Sep. 2, 2021

(65) Prior Publication Data

US 2023/0098498 A1 Mar. 30, 2023

Related U.S. Application Data

(60) Provisional application No. 62/982,319, filed on Feb. 27, 2020.

(51) Int. Cl.
*E02F 9/22* (2006.01)

(52) U.S. Cl.
CPC ..... *E02F 9/2203* (2013.01); *E02F 9/2246* (2013.01)

(58) Field of Classification Search
CPC ..... E02F 9/207; E02F 9/2203; E02F 9/2246; E02F 9/22–2296; F15B 11/165; F15B 21/082
See application file for complete search history.

(56) References Cited

U.S. PATENT DOCUMENTS 4,485,623 A * 12/1984 Chichester ..... B66F 9/22 60/431
6,074,170 A * 6/2000 Bert ..... F04B 13/00 417/415

(Continued)

FOREIGN PATENT DOCUMENTS

EP 2775150 A1 9/2014
EP 3489424 A1 5/2019

(Continued)

OTHER PUBLICATIONS

International Search Report and Written Opinion for PCT Application No. PCT/US2021/019506 dated Jun. 28, 2021 (12 pages).

*Primary Examiner* — Abiy Teka
*Assistant Examiner* — Matthew Wiblin
(74) *Attorney, Agent, or Firm* — Rickard K. DeMille; Rebecca L. Henkel; Peter K. Zacharias

(57) ABSTRACT

An electric work vehicle a pump configured to supply hydraulic fluid to a component of the electric work vehicle. Moreover, the electric work vehicle includes a sensor configured to capture data indicative of a pressure of the hydraulic fluid and a controller communicatively coupled to the sensor. As such, the controller is configured to monitor the pressure of the hydraulic fluid relative to a predetermined threshold pressure value based on the data captured the sensor. In addition, the controller is configured to control (Continued)

the operation of the pump such that the pump is switched from a first operating speed range to a second operating speed range when the monitored pressure of the hydraulic fluid falls below the predetermined threshold pressure value.

20 Claims, 3 Drawing Sheets

(56) References Cited

U.S. PATENT DOCUMENTS

| | | | | |
|---|---|---|---|---|
| 7,281,903 | B2 * | 10/2007 | Reverberi | H02P 7/295 417/44.1 |
| 7,894,963 | B2 | 2/2011 | Shenoy et al. | |
| 8,051,653 | B2 * | 11/2011 | Hsu | F04B 49/20 60/431 |
| 8,528,684 | B2 | 9/2013 | Laws et al. | |
| 2013/0144472 | A1 * | 6/2013 | Ruth | G05D 1/0278 903/902 |
| 2015/0176249 | A1 | 6/2015 | McKee et al. | |
| 2016/0091004 | A1 * | 3/2016 | Gomm | F15B 11/10 60/431 |
| 2017/0203755 | A1 * | 7/2017 | Sugiyama | B60W 10/06 |
| 2019/0345695 | A1 * | 11/2019 | Kumeuchi | E02F 9/2095 |
| 2020/0263763 | A1 * | 8/2020 | Cai | E02F 9/202 |
| 2021/0285187 | A1 * | 9/2021 | Jagoda | E02F 9/265 |

FOREIGN PATENT DOCUMENTS

| | | | |
|---|---|---|---|
| JP | 2008256037 | A | 10/2008 |
| JP | 2011017431 | A | 1/2011 |
| JP | 5390436 | B2 | 10/2013 |

* cited by examiner

SYSTEM AND METHOD FOR CONTROLLING PUMP OPERATING SPEED RANGE OF AN ELECTRIC WORK VEHICLE BASED ON HYDRAULIC FLUID PRESSURE

FIELD OF THE INVENTION

The present disclosure generally relates to electric work vehicles and, more particularly, to systems and methods for controlling the operating speed range of a pump of an electric work vehicle, such as an electric backhoe loader, based on hydraulic fluid pressure.

BACKGROUND OF THE INVENTION

Work vehicles, such as backhoe loaders, wheel loaders, skid steer loaders, compact track loaders, and the like, are a mainstay of construction work and industry. As such, work vehicles typically include one or more implements for carrying materials, such as gravel, sand, or dirt, around a worksite. For example, backhoe loaders include a chassis, a loader assembly coupled to the front of the chassis, and a backhoe assembly coupled to the rear of the chassis.

Typically, work vehicles include a hydraulic system having one or more hydraulic cylinders for raising and lowering each implement relative to the chassis. In this respect, the hydraulic system includes a pump that pressurizes hydraulic fluid within the system for extending/retracting the hydraulic cylinder(s). Conventional work vehicles generally rely on an internal combustion engine to generate power necessary to rotationally drive the pump. However, electric work vehicles do not include an internal combustion engine. Instead, electric work vehicles rely on an electric motor powered by a battery(ies) to rotationally drives the pump. As such, it generally desirable to limit the power consumption of the pump to maximize the life or time between charging of the battery(ies).

Accordingly, an improved system and method for controlling the operating speed range of a pump of an electric work vehicle would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to an electric work vehicle. The electric work vehicle includes a chassis and an electric traction motor supported on the chassis, with the electric traction motor configured to propel the electric construction vehicle in a direction of travel. Additionally, the electric work vehicle includes an implement adjustably coupled to the chassis and a hydraulic actuator configured to adjust a position of the implement relative to the chassis. Furthermore, the electric work vehicle includes a pump configured to supply hydraulic fluid to the hydraulic actuator. The pump is, in turn, operable within a first operating speed range extending from a minimum operating speed value to a maximum operating speed value and a second operating speed range extending from a minimum operating speed value to a maximum operating speed value. The maximum operating speed value of the first operating speed range is greater than the maximum operating speed value of the second operating speed range, and the minimum operating speed value of the first operating speed range is greater than the minimum operating speed value of the second operating speed range. Moreover, the electric work vehicle includes a sensor configured to capture data indicative of a pressure of the hydraulic fluid and a controller communicatively coupled to the sensor. As such, the controller is configured to monitor the pressure of the hydraulic fluid relative to a predetermined threshold pressure value based on the data captured the sensor. In addition, the controller is configured to control an operation of the pump such that the pump is switched from the first operating speed range to the second operating speed range when the monitored pressure of the hydraulic fluid falls below the predetermined threshold pressure value.

In another aspect, the present subject matter is directed to a system for controlling a pump operating speed range of an electric work vehicle. The system includes a pump configured to supply hydraulic fluid to a component of the electric work vehicle. Additionally, the system includes an electric pump motor configured to rotationally drive the pump such that the pump is operable within a first operating speed range extending from a minimum operating speed value to a maximum operating speed value and a second operating speed range extending from a minimum operating speed value to a maximum operating speed value. The maximum operating speed value of the first operating speed range is greater than the maximum operating speed value of the second operating speed range, and the minimum operating speed value of the first operating speed range is greater than the minimum operating speed value of the second operating speed range. Furthermore, the system includes a sensor configured to capture data indicative of a pressure of the hydraulic fluid and a controller communicatively coupled to the sensor. As such, the controller is configured to monitor the pressure of the hydraulic fluid relative to a predetermined threshold pressure value based on the data captured the sensor. Moreover, the controller is configured to control an operation of the electric pump motor such that the pump is switched from the first operating speed range to the second operating speed range when the monitored pressure of the hydraulic fluid falls below the predetermined threshold pressure value.

In a further aspect, the present subject matter is directed to a method for controlling a pump operating speed range of an electric work vehicle. The electric work vehicle, in turn, includes a pump configured to supply hydraulic fluid to a component of the electric work vehicle. Additionally, the electric work vehicle includes an electric pump motor configured to rotationally drive the pump. The method includes receiving, with one or more computing devices, sensor data indicative of a pressure of the hydraulic fluid. Furthermore, the method includes monitoring, with the one or more computing devices, the pressure of the hydraulic fluid relative to a predetermined threshold pressure value based on the received sensor data. Moreover, the method includes controlling, with the one or more computing devices, an operation of the electric pump motor such that of the pump is switched from a first operating speed range extending from a minimum operating speed value to a maximum operating speed value to the second operating speed range extending from a minimum operating speed value to a maximum operating speed value when the monitored pressure of the hydraulic fluid falls below the predetermined threshold pressure value. The maximum operating speed value of the first operating speed range is greater than the maximum operating speed value of the second operating speed range, and the minimum operating speed value of the first operating speed range is greater than the minimum operating speed value of the second operating speed range.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
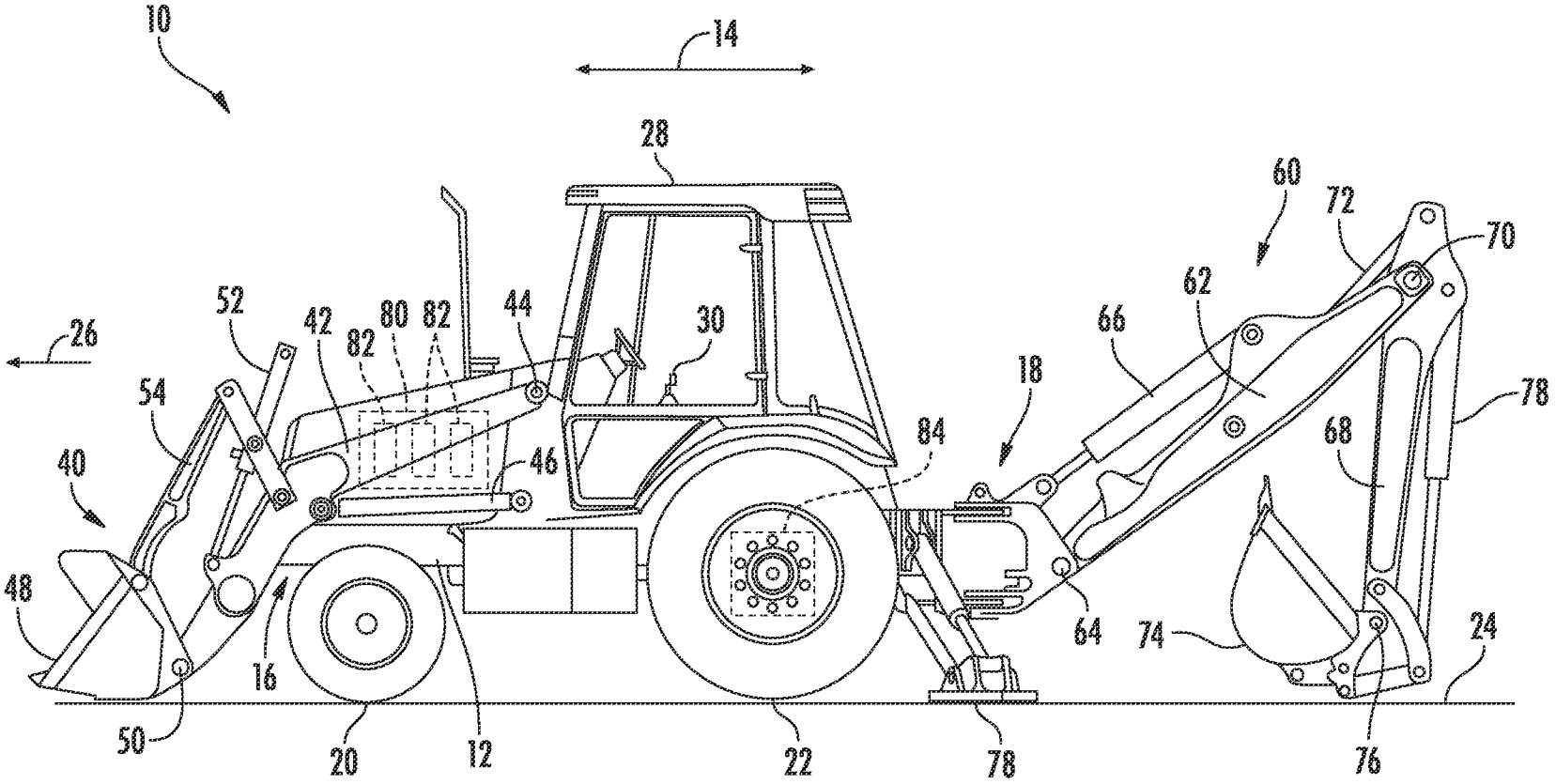
FIG. 1 illustrates a side view of one embodiment of electric work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for controlling the operating speed range of a pump of an electric work vehicle. As will be described below, the present subject matter may be used with an electric backhoe loader or any other electric work vehicle that uses hydraulic fluid to operate one or more of its components. In this respect, the electric work vehicle may include one or more hydraulic actuators configured to adjust the position(s) of one or more implements (e.g., a loader assembly and/or a backhoe assembly) relative to a chassis of the vehicle. Moreover, the electric work vehicle may include a pump configured to supply hydraulic fluid to the hydraulic actuator(s). Additionally, the electric work vehicle may include an electric pump motor configured to rotationally drive the pump such that the pump is operable within a first or normal operating speed range and a second or energy-saving operating speed range.

In accordance with aspects of the present subject matter, a controller of the disclosed system may be configured to control the operation of the pump such that the pump is switched between the normal and energy-saving operating speed ranges based on the hydraulic fluid pressure. Specifically, in several embodiments, the controller may be configured to monitor the pressure of the hydraulic fluid supplied by the pump relative to a predetermined threshold pressure value. Thereafter, when the monitored pressure falls below the predetermined threshold pressure value, the controller may be configured to control the operation of the electric pump motor such that the pump is switched from the normal operating speed range to the energy-saving operating speed range. Such a switch in the operating speed range may, in turn, reduce the energy consumption of the vehicle when the load on its hydraulic system is low. Conversely, when the monitored pressure exceeds the predetermined threshold pressure value, the controller may be configured to control the operation of the electric pump motor such that the pump is switched from the energy-saving operating speed range to normal operating speed range. Such a switch in the operating speed range may, in turn, ensure that the output of the hydraulic system is sufficient to operate the various components of the vehicle when the load on its hydraulic system is high.

Referring now to the drawings, FIG. 1 illustrates a side view of one embodiment of an electric work vehicle in accordance with aspects of the present subject matter. As shown, the electric work vehicle is configured as an electric backhoe loader 10 (also often referred to as a "tractor-loader-backhoe" (TLB) or a "loader backhoe"). However, in other embodiments, aspects of the present subject matter may also be utilized within other electric work vehicles, such as various other construction vehicles. For instance, in one embodiment, aspects of the present subject matter may be advantageously utilized with other electric construction vehicles including at least one hydraulically-driven work implement assembly, such as a wheel loader, a skid-steer loader, and/or a bulldozer.

As shown in FIG. 1, the backhoe loader 10 includes a frame or chassis 12 extending in a longitudinal direction (indicated by arrow 14 in FIG. 1) of the backhoe loader 10 between a forward end 16 of the chassis 12 and an aft end 18 of the chassis 12. In general, the chassis 12 may be configured to support or couple to a plurality of components. For example, a pair of steerable front traction devices (e.g., front wheels 20 (one of which is shown)) and a pair of driven rear traction devices (e.g., rear wheels 22 (one of which is shown)) may be coupled to the chassis 12. The wheels 20, 22 may support the backhoe loader 10 relative to a ground surface 24 and move the backhoe loader 10 along the ground surface 24 in a direction of travel, such as a forward direction of travel (indicated by arrow 26 in FIG. 1). However, in alternative embodiments, the front wheels 20 may be driven in addition to or in lieu of the rear wheels 22. Additionally, an operator's cab 28 may be supported by a portion of the chassis 12 positioned between the forward and aft ends 16, 18 of the chassis 12, and may house one or more operator control devices 30 (e.g., a joystick(s), a lever(s), and/or the like) for permitting an operator to control the operation of the backhoe loader 10.

The backhoe loader 10 also includes a pair of hydraulically-driven work implement assemblies positioned at the opposed ends 16, 18 of the chassis 12. Specifically, in the illustrated embodiment, the backhoe loader 10 includes a loader assembly 40 supported by or relative the chassis 12 at or adjacent to its forward end 16. As shown in FIG. 1, the loader assembly 40 includes a loader arm 42 pivotably coupled or supported relative to the chassis 12 at a loader arm pivot point 44, and a loader lift cylinder 46 secured between the loader arm 42 and the chassis 12. In such an embodiment, extension/retraction of the loader lift cylinder 46 may result in the loader arm 42 pivoting upwards/ downwards about its respective pivot point 44, thereby allowing the positioning of the loader arm 42 relative to both the chassis 12 and the ground surface 24 to be adjusted, as desired. Moreover, as shown in FIG. 1, the loader assembly 40 further includes a first work implement 48, such as a loader bucket, coupled to the loader arm 42 at an implement pivot point 50, and a first implement tilt cylinder 52 secured between the work implement 48 (e.g., via a linkage(s) 54) and a portion of the loader arm 44. As such, extension/retraction of the first implement tilt cylinder 52 may result in the first work implement 48 pivoting upwards/downwards relative to the loader arm 42 about its respective pivot point 50, thereby permitting the tilt angle or orientation of the implement 48 to be adjusted, as desired. Thus, by controlling the operation of the lift and tilt cylinders 46, 52 of the loader assembly 40, the vertical positioning and orientation of the first work implement 48 may be adjusted to allow for the execution of one or more operations, such as one or more material-moving operations.

Additionally, the backhoe loader 10 includes a backhoe assembly 60 supported by or relative to the chassis 12 at or adjacent to its aft end 18. As shown in FIG. 1, the backhoe assembly 60 includes a boom 62 pivotably coupled or supported relative to the chassis 12 at a boom pivot point 64, and a boom lift cylinder 66 secured between the boom 62 and the chassis 12. In such an embodiment, extension/retraction of the boom cylinder 66 may result in the boom 62 pivoting upwards/downwards about its respective pivot point 64, thereby allowing the positioning of the boom 62 relative to both the chassis 12 and the ground surface 24 to be adjusted, as desired. The backhoe assembly 60 also includes a dipper arm 68 coupled to the boom 62 at a dipper pivot point 70, and a dipper cylinder 72 secured between the dipper arm 68 and the boom 62. In such an embodiment, extension/retraction of the dipper cylinder 72 may result in the dipper arm 68 pivoting upwards/downwards about its respective pivot point 70 relative to the boom 62. Moreover, as shown in FIG. 1, the backhoe assembly 60 further includes a second work implement 74, such as a dipper bucket, coupled to the dipper arm 68 at an implement pivot point 76, and a second implement tilt cylinder 78 secured between the work implement 74 and a portion of the dipper arm 68. As such, extension/retraction of the second implement tilt cylinder 78 may result in the second work implement 74 pivoting upwards/downwards relative to the dipper arm 68 about its respective pivot point 76, thereby permitting the tilt angle or orientation of the implement 74 to be adjusted, as desired. Thus, by controlling the operation of the various cylinders 66, 72, 78 of the backhoe assembly 60, the vertical positioning and orientation of the second work implement 74 may be adjusted to allow for the execution of one or more operations, such as one or more material excavation operations.

As shown in FIG. 1, the backhoe loader 10 may also include a pair of stabilizer legs 78 (one of which is shown) positioned at or adjacent to the aft end 18 of the chassis 12. The stabilizer legs 78 may be configured to support the weight of the backhoe loader 10 and/or otherwise stabilize the backhoe loader 10 during the performance of a backhoe-related operation. For instance, the stabilizer legs 78 may be pivotably coupled to the chassis 12 to allow the legs 78 to be moved or pivoted (e.g., via the operation of an associated stabilizer leg cylinder 78) between a lowered position, at which the legs 78 contact the ground surface 24, and a raised position, at which the legs 78 are lifted off the ground surface 24 to allow movement of the backhoe loader 10 (e.g., in the forward direction of travel 26). In addition to lowering the stabilizer legs 78, the loader assembly 40 may also be lowered during the performance of a backhoe-related operation such that the first work implement 48 contacts the ground, thereby providing a point-of-contact to stabilize the front end 16 of the chassis 12.

Furthermore, the backhoe loader 10 may include an electric drivetrain configured to propel the backhoe loader 10 in the direction of the travel. For example, in the illustrated embodiment, the electric drivetrain includes a power storage device, such as a battery module 80 having three batteries 82, supported on and positioned adjacent to the forward end 16 of the chassis 12. Moreover, in the illustrated embodiment, the electric drivetrain includes a pair of electric traction motors 84 (one of which is shown) supported on the chassis 12, with each motor 84 coupled to one of the driven wheels 22 via a suitable shaft (not shown). More specifically, the batteries 82 may be configured to provide electric power for use in powering the electric traction motors 84 and other power-consuming components of the backhoe loader 10 (e.g., an electric hydraulics-driving motor 102 (FIG. 2) of the backhoe loader 10). Each electric traction motor 84 may, in turn, rotationally drive the corresponding rear wheel 22, thereby propelling the backhoe loader 10 in the forward direction of travel 26. However, in alternative embodiments, the electric drivetrain of the backhoe loader 10 may have any other suitable configuration. For example, in one embodiment, the backhoe loader 10 may include as a single electric traction motor coupled to a transmission (not shown) that transmits the torque generated by the electric traction motor to each of the rear wheels 22. In another embodiment, the backhoe loader 10 may include an electric traction motor coupled to each of the wheels 20, 22. Furthermore, the battery module 80 may include any other suitable number of batteries 82.

In addition, the backhoe loader 10 may include various components for controlling the operation of the electric drivetrain. For instance, although not shown, one or more power inverters may be coupled to the battery module 80 via a direct current (DC) voltage bus or any other suitable electrical coupling for converting the direct current supplied by the batteries 82 of the battery module 80 to an alternating current for powering the electric traction motors 84 and the electric hydraulics-driving motor 102. An associated motor/inverter controller(s) may control the operation of the power inverter(s) in a manner that drives each electric motor 84, 102 as desired, such as by ensuring that each motor 84, 102 is driven to achieve a desired speed and/or torque output.

The configuration of the backhoe loader 10 described above and shown in FIG. 1 is provided only to place the present subject matter in an exemplary field of use. Thus, the present subject matter may be readily adaptable to any manner of electric vehicle configuration. For instance, in addition to a backhoe loader, aspects of the present subject matter may also be applied within electric construction vehicles only including a single work implement assembly positioned at one end of the vehicle's chassis, such as a wheel loader, skid-steer loader, bulldozer, and/or the like.

Figure 2:
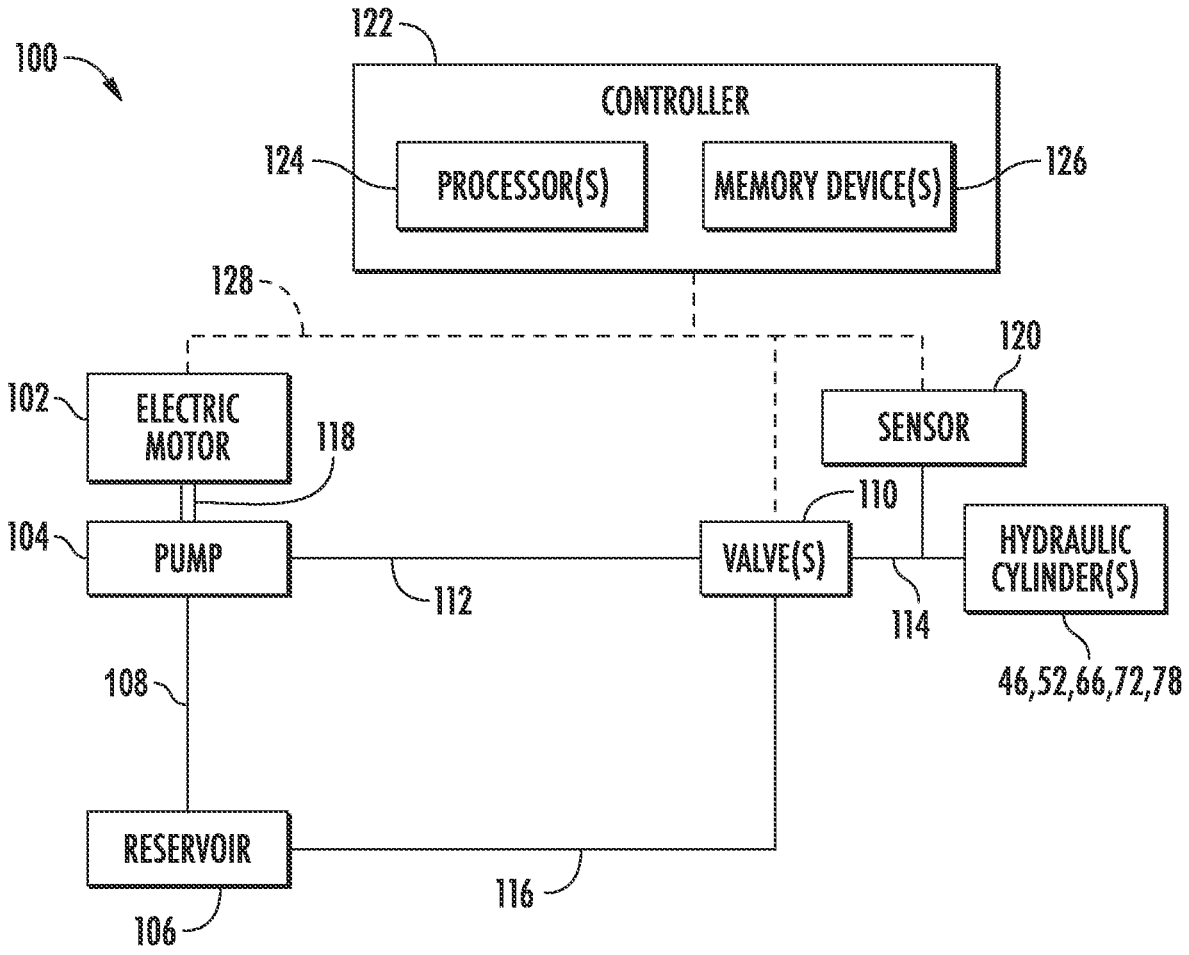
FIG. 2 illustrates a schematic view of one embodiment of a system for controlling the operating speed range of a pump of an electric work vehicle in accordance with aspects of the present subject matter.

Referring now to FIG. 2, a schematic view of one embodiment of a system 100 for controlling the operating speed range of a pump of an electric work vehicle is illustrated in accordance with aspects of the present subject matter. In general, the system 100 will be described herein with reference to the backhoe loader 10 described above with reference to FIG. 1. However, the disclosed system 100 may generally be utilized with electric work vehicles having any other suitable electric vehicle configuration. For purposes of illustration, hydraulic connections between components of the system 100 are shown in solid lines, while electrical connections between components of the system 100 are shown in dashed lines.

As shown in FIG. 2, the system 100 may include various components of the hydraulic system of the backhoe loader 10. In several embodiments, the system 100 may include a pump 104 configured to supply hydraulic fluid to one or more hydraulic actuators of the backhoe loader 10, such as the hydraulic cylinders 46, 52, 66, 72, 78. More specifically, the pump 104 may be in fluid communication with a fluid tank or reservoir 106 (via a pump line 108) and one or more control valves 110 (e.g., via a supply line 112). The control valve(s) 106 may, in turn, be in fluid communication with the hydraulic cylinders 46, 52, 66, 72, 78 (e.g., via the cylinder lines 114—one is shown in FIG. 2) and the reservoir 108 (e.g., via a return line 116). In this respect, the pump 104 may be configured to receive hydraulic fluid from the reservoir 106 (e.g., via the pump line 108) and discharge a pressurized flow of the hydraulic fluid into the supply line 112. The control valve(s) 106 may regulate the flow of the pressurized hydraulic fluid from the supply line 112 to each of the hydraulic cylinders 46, 52, 66, 72, 78. By regulating the flow of hydraulic fluid generated by the pump 104 (e.g., by controlling the operation of the pump 104 and/or the control valve(s) 110), the movement of the loader assembly and the backhoe assembly 60 may be controlled. In addition, the control valve(s) 110 may regulate the return of the hydraulic fluid from the hydraulic cylinders 46, 52, 66, 72, 78 to the reservoir 106.

The pump 104 may be operable within a first or normal operating speed range and a second or energy-saving operating speed range to pressurize the received hydraulic fluid for supply to the hydraulic cylinders 46, 52, 66, 72, 78. In general, the normal operating speed range may correspond to a range of higher operating speeds (e.g., speeds of the impeller of the pump 104) for use when the load on the hydraulic system of the backhoe loader 10 is high. In this respect, when operating within the normal operating speed range, the pump 104 generates sufficient flow of the pressurized hydraulic fluid to operate the various components of the vehicle (e.g., the hydraulic cylinders 46, 52, 66, 72, 78) when the load on its hydraulic system is high (e.g., when the loader assembly 40 or the backhoe assembly 60 are lifting material). Conversely, the energy-saving operating speed range may correspond to a range of lower operating speeds (e.g., speeds of the impeller of the pump 104) for use when the load on the hydraulic system of the backhoe loader 10 is low (e.g., when the loader assembly 40 and the backhoe assembly 60 are stationary). As such, when operating within the energy-saving operating speed range, the pump 104 generates less flow of the hydraulic fluid, thereby reducing the energy consumption of the backhoe loader 10 and extending the life or the time between charges of the batteries 82.

The normal and energy-saving operating speed ranges may extend between a minimum operating speed value (e.g., a minimum rotational speed value of the impeller) and a maximum operating speed value (e.g., a minimum rotational speed value of the impeller). Specifically, in several embodiments, the maximum operating speed value of the normal operating speed range may be greater than the maximum operating speed value of the energy-saving operating speed range. Similarly, the minimum operating speed value of the normal operating speed range may be greater than the minimum operating speed value of the energy-saving operating speed range. In one embodiment, the minimum operating speed value of the normal operating speed range may be greater than the maximum operating speed value of the energy-saving operating speed range such that the entire normal operating speed range is greater than the entire energy-saving operating speed range. In another embodiment, the minimum operating speed value of the normal operating speed range may be less than or equal to the maximum operating speed value of the energy-saving operating speed range such that a portion of the normal operating speed range overlaps with a portion of energy-saving operating speed range.

In several embodiments, the pump 104 may be driven by an electric hydraulics-driving motor 102 within the normal and the energy-saving operating speed ranges. More specifically, in such embodiments, the electric hydraulics-driving motor 102 may be powered by the battery module 80 (FIG. 1) and mechanically coupled to the pump 104 via an output shaft 118. In this respect, a motor/inverter controller and associated power inverter may control the operation of the electric hydraulics-driving motor 102 such that the electric hydraulics-driving motor 102 rotationally drives the impeller of the pump 104 at an operating speed within the normal or energy-saving operating speed ranges based on the pressure of the hydraulic fluid within the hydraulic system of the backhoe loader 10.

Referring still to FIG. 2, the system 100 may include a pressure sensor 120 in operative association with the hydraulic system of the backhoe loader 10. In general, the pressure sensor 120 may be configured to capture data indicative of the pressure of the hydraulic fluid within the hydraulic system. For example, in several embodiments, the pressure sensor 120 may be configured as a diaphragm-based pressure sensor. Moreover, in the illustrated embodiment, the pressure sensor 120 is in operative association with cylinder line 114 such that the pressure sensor 120 is in contact with the hydraulic fluid flowing through the cylinder line 114. However, in alternative embodiments, the pressure sensor 120 be configured as any other suitable device for capturing data indicative of the pressure of the hydraulic fluid and/or be in operative association with any other suitable component of the hydraulic system.

In accordance with aspects of the present subject matter, the system 100 may include a controller 122 positioned on and/or within or otherwise associated with the backhoe loader 10. In general, the controller 122 may comprise any suitable processor-based device known in the art, such as a computing device or any suitable combination of computing devices. Thus, in several embodiments, the controller 122 may include one or more processor(s) 124 and associated memory device(s) 126 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 126 of the controller 122 may generally comprise memory element(s) including, but not limited to, a computer readable medium (e.g., random access memory (RAM)), a computer readable non-volatile medium (e.g., a flash memory), a floppy disc, a compact disc-read only memory (CD-ROM), a magneto-optical disc (MOD), a digital versatile disc (DVD), and/or other suitable memory elements. Such memory device(s) 126 may generally be configured to store suitable computer-readable instructions that, when implemented by the processor(s) 124, configure the controller 122 to perform various computer-implemented functions.

In addition, the controller 122 may also include various other suitable components, such as a communications circuit or module, a network interface, one or more input/output channels, a data/control bus and/or the like, to allow controller 122 to be communicatively coupled to any of the various other system components described herein (e.g., the electric hydraulics-driving motor 102 (or an associated inverter), the valve(s) 110, and/or the pressure sensor 120). For instance, as shown in FIG. 2, a communicative link or interface 128 (e.g., a data bus) may be provided between the controller 122 and the components 102, 110, 120 to allow the controller 122 to communicate with such components 102, 110, 120 via any suitable communications protocol (e.g., CANBUS).

The controller 122 may correspond to an existing controller(s) of the backhoe loader 10, itself, or the controller 122 may correspond to a separate processing device. For instance, in one embodiment, the controller 122 may form all or part of a separate plug-in module that may be installed in association with the backhoe loader 10 to allow for the disclosed systems to be implemented without requiring additional software to be uploaded onto existing control devices of the backhoe loader 10.

The functions of the controller 122 may be performed by a single processor-based device or may be distributed across any number of processor-based devices, in which instance such devices may be considered to form part of the controller 122. For instance, the functions of the controller 122 may be distributed across multiple application-specific controllers, such as a vehicle controller, a hydraulic system controller, an electric traction motor controller/electric traction motor inverter controller, an electric hydraulics-driving motor controller/electric hydraulics-driving motor inverter controller, and/or the like.

In several embodiments, the controller 122 may be configured to monitor the pressure of the hydraulic fluid within the hydraulic system of the backhoe loader 10. As described above, the backhoe loader 10 may include a pressure sensor 120 configured to capture data indicative of the pressure of the hydraulic fluid. In this respect, during operation of the backhoe loader 10, the controller 122 may be configured to receive the captured data from the pressure sensor 120 (e.g., via the communicative link 128). Thereafter, the controller 122 may be configured to process/analyze the received sensor data to determine the pressure of the hydraulic fluid within the hydraulic system. For instance, the controller 122 may include a look-up table(s) and/or suitable mathematical formula stored within its memory device(s) 126 that correlates the received sensor data to the pressure of the hydraulic fluid.

In accordance with aspects of the present subject, the controller 122 may be configured to control the operation of the pump 104 such that the pump 104 is switched between the normal and energy-saving operating speed ranges based on the monitored pressure of the hydraulic fluid. As described above, the normal operating speed range of the pump 104 may generally correspond to a range of higher operating speeds at which the output of pump 104 (e.g., volume of the pressurized fluid) is sufficient to operate the various components of the backhoe loader 10 when the load on its hydraulic system is high. Conversely, the normal operating speed range of the pump 104 may generally correspond to a range of lower operating speeds at which the output of the pump 104 is lower for use when the load on the hydraulic system is low. In this respect, when monitored pressure of the hydraulic fluid falls below a predetermined threshold pressure value (thereby indicating that the load on the hydraulic system is low), the controller 122 may be configured to control the operation of the pump 104 such that the pump 104 is switched from the normal operating speed range to the energy-saving operating speed range. When monitored pressure of the hydraulic fluid exceeds the predetermined threshold pressure value (thereby indicating that the load on the hydraulic system is high), the controller 122 may be configured to control the operation of the pump 104 such that the pump 104 is switched from the energy-saving operating speed range to the normal operating speed range.

In several embodiments, the controller 122 may be configured to control the operation of the electric hydraulics-driving motor 102 to switch the pump 104 between the normal and energy-saving operating speed ranges. Specifically, the controller 122 may be configured to transmit control signals to the motor/inverter controller of the electric hydraulics-driving motor 102 via the communicative link 128 to control the operating speed range of the pump 104. When switching from the normal operating speed range to the energy-saving operating speed range, the control signals may instruct the electric hydraulics-driving motor 102 to switch from rotationally driving the pump 104 at an operating speed within the normal operating speed range to an operating speed within the energy-saving operating speed range. Conversely, when switching from the energy-saving operating speed range to the normal operating speed range, the control signals may instruct the electric hydraulics-driving motor 102 to switch from rotationally driving the pump 104 at an operating speed within the energy-saving operating speed range to an operating speed within the normal operating speed range.

Adjusting the operating speed range of the pump 104 based on the monitored pressure of the hydraulic fluid within the hydraulic system of the backhoe loader 10 may reduce the energy consumption of the backhoe loader 10. More specifically, when the load on the hydraulic system of the backhoe loader 10 is low (e.g., when the loader assembly 40 and the backhoe assembly 60 are stationary), the pump 104 may only need to provide a low output or hydraulic fluid flow volume. In such instances (i.e., when the monitored pressure of the hydraulic fluid falls below the predetermined threshold pressure value), switching the pump 104 to the energy-saving operating speed range may reduce the energy consumption of the backhoe loader 10, thereby extending the life of or the time between charging of the batteries 82. However, when the load on the hydraulic system of the backhoe loader 10 is high (e.g., when the loader assembly 40 or the backhoe assembly 60 are lifting material), the pump 104 may need to provide a high output or hydraulic fluid flow volume. In such instances (i.e., when the monitored pressure of the hydraulic fluid exceeds the predetermined threshold pressure value), switching the pump 104 to the normal operating speed range may ensure the hydraulic system has sufficient flow volume to operate the various components of the backhoe loader 10 (e.g., the hydraulic cylinders 46, 52, 66, 72, 78).

Figure 3:
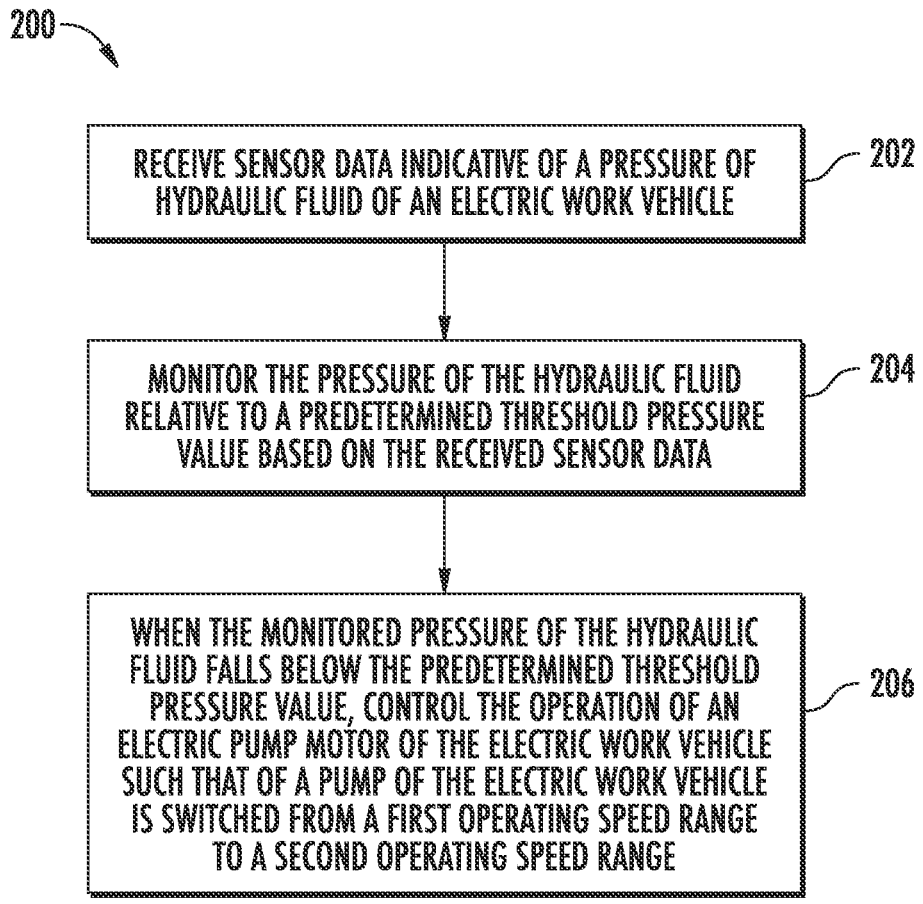
FIG. 3 illustrates a flow diagram of one embodiment of a method for controlling the operating speed range of a pump of an electric work vehicle in accordance with aspects of the present subject matter.

Referring now to FIG. 3, a flow diagram of one embodiment of a method 200 for controlling the operating speed range of a pump of an electric work vehicle is illustrated in accordance with aspects of the present subject matter. In general, the method 200 will be described herein with reference to the backhoe loader 10 and the system 100 described above with reference to FIGS. 1 and 2. However, the disclosed method 200 may generally be implemented with any electric work vehicle having any suitable electric vehicle configuration and/or within any system having any suitable system configuration. In addition, although FIG. 3 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 3, at (202), the method 200 may include receiving, with one or more computing devices, sensor data indicative of a pressure of hydraulic fluid of an electric work vehicle. For instance, as described above, the controller 122 may be configured to receive data from the pressure sensor 120 (e.g., via the communicative link 128) indicative of the pressure of the hydraulic fluid within the hydraulic system of the backhoe loader 10.

Additionally, at (204), the method 200 may include monitoring, with the one or more computing devices, the pressure of the hydraulic fluid relative to a predetermined threshold pressure value based on the received sensor data. For instance, as described above, the controller 122 may be configured to monitor the pressure of the hydraulic fluid relative to a predetermined threshold pressure value based on the received sensor data.

Moreover, as shown in FIG. 3, at (206), when the monitored pressure of the hydraulic fluid falls below the predetermined threshold pressure value, the method 200 may include controlling the operation of an electric pump motor of the electric work vehicle such that of a pump of the electric work vehicle is switched from a first operating speed range to a second operating speed range. For instance, as described above, when the monitored pressure of the hydraulic fluid falls below the predetermined threshold pressure value, the controller 122 may be configured to control the operation of the electric hydraulics-driving motor 102 such that of the pump 104 is switched from the first or normal operating speed range to the second or energy-saving operating speed range.

It is to be understood that the steps of the method 200 are performed by the controller 122 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the controller 122 described herein, such as the method 200, is implemented in software code or instructions which are tangibly stored on a tangible computer readable medium. The controller 122 loads the software code or instructions via a direct interface with the computer readable medium or via a wired and/or wireless network. Upon loading and executing such software code or instructions by the controller 122, the controller 122 may perform any of the functionality of the controller 122 described herein, including any steps of the method 200 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. An electric work vehicle, comprising:

a chassis;

an electric traction motor supported on the chassis, the electric traction motor configured to propel the electric work vehicle in a direction of travel;

an implement adjustably coupled to the chassis;

a hydraulic actuator configured to adjust a position of the implement relative to the chassis;

a pump configured to supply hydraulic fluid to the hydraulic actuator, the pump operable within a first operating speed range extending from a minimum operating speed value to a maximum operating speed value, the pump further operable within a second operating speed range extending from a minimum operating speed value to a maximum operating speed value, the maximum operating speed value of the first operating speed range being greater than the maximum operating speed value of the second operating speed range, the minimum operating speed value of the first operating speed range being greater than the minimum operating speed value of the second operating speed range; and a sensor configured to capture data indicative of a pressure of the hydraulic fluid; and a controller communicatively coupled to the sensor, the controller configured to:

monitor the pressure of the hydraulic fluid relative to a predetermined threshold pressure value based on the data captured the sensor; and control an operation of the pump such that the pump is switched from the first operating speed range to the second operating speed range when the monitored pressure of the hydraulic fluid falls below the predetermined threshold pressure value.

2. The electric work vehicle of claim 1, wherein the controller is further configured to control the operation of the pump such that the pump is switched from the second operating speed range to the first operating speed range when the monitored pressure of the hydraulic fluid exceeds the predetermined threshold pressure value.

3. The electric work vehicle of claim 2, further comprising:

an electric pump motor configured to rotationally drive the pump.

4. The electric work vehicle of claim 3, wherein, when controlling operation of the pump such that the pump is switched from the first operating speed range to the second operating speed range, the controller is further configured to control the operation of the electric pump motor such that the pump is switched from the first operating speed range to the second operating speed range.

5. The electric work vehicle of claim 3, wherein, when controlling the operation of the pump such that the pump is switched from the second operating speed range to the first operating speed range, the controller is further configured to control the operation of the electric pump motor such that the pump is switched from the second operating speed range to the first operating speed range.

6. The electric work vehicle of claim 1, wherein the minimum operating speed value of the first range is greater than the maximum operating speed value of the second range.

7. The electric work vehicle of claim 1, wherein the minimum operating speed value of the first range is less than or equal to the maximum operating speed value of the second range.

8. The electric work vehicle of claim 1, wherein the implement comprises at least one of a loader assembly or a backhoe assembly.

9. The electric work vehicle of claim 1, wherein the work vehicle corresponds to a backhoe loader.

10. A system for controlling a pump operating speed range of an electric work vehicle, the system comprising:

a pump configured to supply hydraulic fluid to a component of the electric work vehicle; an electric pump motor configured to rotationally drive the pump such that the pump is operable within a first operating speed range extending from a minimum operating speed value to a maximum operating speed value and a second operating speed range extending from a minimum operating speed value to a maximum operating speed value, the maximum operating speed value of the first operating speed range being greater than the maximum operating speed value of the second operating speed range, the minimum operating speed value of the first operating speed range being greater than the minimum operating speed value of the second operating speed range;

a sensor configured to capture data indicative of a pressure of the hydraulic fluid; and a controller communicatively coupled to the sensor, the controller configured to:

monitor the pressure of the hydraulic fluid relative to a predetermined threshold pressure value based on the data captured the sensor; and control an operation of the electric pump motor such that the pump is switched from the first operating speed range to the second operating speed range when the monitored pressure of the hydraulic fluid falls below the predetermined threshold pressure value.

11. The system of claim 10, wherein the controller is further configured to control the operation of the pump such that the pump is switched from the second operating speed range to the first operating speed range when the monitored pressure of the hydraulic fluid exceeds the predetermined threshold pressure value.

12. The system of claim 10, wherein the minimum operating speed value of the first range is greater than the maximum operating speed value of the second range.

13. The system of claim 10, wherein the minimum operating speed value of the first range is less than or equal to the maximum operating speed value of the second range.

14. The system of claim 10, wherein the component comprises a hydraulic actuator configured to adjust a position of an implement of the electric work vehicle.

15. The system of claim 14, wherein the implement comprises at least one of a loader assembly or a backhoe assembly.

16. A method for controlling a pump operating speed range of an electric work vehicle, the electric work vehicle including a pump configured to supply hydraulic fluid to a component of the electric work vehicle, the electric work vehicle further including an electric pump motor configured to rotationally drive the pump, the method comprising:

receiving, with one or more computing devices, sensor data indicative of a pressure of the hydraulic fluid;

monitoring, with the one or more computing devices, the pressure of the hydraulic fluid relative to a predetermined threshold pressure value based on the received sensor data; and controlling, with the one or more computing devices, an operation of the electric pump motor such that the pump is switched from a first operating speed range extending from a minimum operating speed value to a maximum operating speed value to the second operating speed range extending from a minimum operating speed value to a maximum operating speed value when the monitored pressure of the hydraulic fluid falls below the predetermined threshold pressure value, the maximum operating speed value of the first operating speed range being greater than the maximum operating speed value of the second operating speed range, the minimum operating speed value of the first operating speed range being greater than the minimum operating speed value of the second operating speed range.

17. The system of method of 16, further comprising:

controlling, with the one or more computing devices, the operation of the pump such that the pump is switched from the second operating speed range to the first operating speed range when the monitored pressure of the hydraulic fluid exceeds the predetermined threshold pressure value.

18. The method of claim 16, wherein the minimum operating speed value of the first range is greater than the maximum operating speed value of the second range.

19. The method of claim 16, wherein the minimum operating speed value of the first range is less than or equal to the maximum operating speed value of the second range.

20. The method of claim 16, wherein the component comprises a hydraulic actuator configured to adjust a position of an implement of the electric work vehicle.

* * * * *